US008794168B2

(12) United States Patent
Groβ et al.

(10) Patent No.: US 8,794,168 B2
(45) Date of Patent: Aug. 5, 2014

(54) SUPPLY DEVICE

(75) Inventors: Hans-Rochus Groβ, Bergisch Gladbach (DE); Klaus Stutznäcker, Frechen (DE)

(73) Assignee: Nahmaschinefabrik Emil Stutznacker GmbH & Co., Cologne (DE)

( * ) Notice: Subject to any disclaimer, the term of this patent is extended or adjusted under 35 U.S.C. 154(b) by 993 days.

(21) Appl. No.: 12/777,702

(22) Filed: May 11, 2010

(65) Prior Publication Data

US 2011/0030599 A1 Feb. 10, 2011

(30) Foreign Application Priority Data

May 12, 2009 (DE) ..... 10 2009 020 961
Aug. 12, 2009 (DE) ..... 10 2009 036 989

(51) Int. Cl.
*D05B 1/00* (2006.01)

(52) U.S. Cl.
USPC ..... 112/475.07

(58) Field of Classification Search
USPC ..... 112/475.07, 475.08, 2.1, 148, 152, 153, 112/475.17, 475.18, 470.13, 470.14; 5/717, 5/739, 740
See application file for complete search history.

(56) References Cited

U.S. PATENT DOCUMENTS 3,160,124 A * 12/1964 Cash, Jr. ..... 112/470.12
4,327,653 A 5/1982 Blessing
5,154,130 A * 10/1992 Gribetz et al. ..... 112/292
5,603,270 A 2/1997 White et al.
5,860,374 A * 1/1999 Jensen et al. ..... 112/102.5
6,786,164 B2 * 9/2004 Myers et al. ..... 112/475.08
7,735,439 B1 * 6/2010 Price et al. ..... 112/117
2003/0136319 A1 7/2003 Myers et al.

FOREIGN PATENT DOCUMENTS

CN 1096516 C 12/2002
CN 1617962 A 5/2005
DE 40 32 052 A1 5/1991
DE 203 17 988 U1 9/2004

(Continued)

OTHER PUBLICATIONS

English translation of DE 4032052 (A1).

(Continued)

*Primary Examiner* — Tejash Patel
(74) *Attorney, Agent, or Firm* — Advitam IP, LLC

(57) ABSTRACT

The invention relates to a supply device (32) for sewing material layers (16, 18, 20) of a large area sewing product such as mattress panels for example, comprising several sewing material layers (16, 18, 20), particularly at least three, preferably one sewing material layer of elastic material, for example foamed material, and one sewing material layer intended as a top layer, which layers are to be stitched together using a sewing machine (14) with at least one sewing unit, in particular a multiple-needle sewing machine, wherein said supply device consists of at least one roll receiver (34) capable of receiving at least two material rolls (24, 26, 28, 36, 38, 40), each material roll (24, 26, 28, 36, 38, 40) being rotatably supported in a holder (42) of the roll receiver (34), and wherein sewing material layers (16, 18, 20) can be removed from the material rolls (24, 26, 28, 36, 38, 40) arranged in a roll receiver (34) and fed to the sewing unit, wherein the sewing material layers (16, 18, 20) from a roll receiver (34) can be alternatively fed to the sewing unit.

28 Claims, 7 Drawing Sheets

(56) References Cited

FOREIGN PATENT DOCUMENTS

| | | | |
|---|---|---|---|
| DE | 10 2007 017 235 | A1 | 11/2007 |
| DE | 10 2007 056 132 | A1 | 6/2008 |
| GB | 894657 | | 4/1962 |
| WO | 00/50683 | | 8/2000 |
| WO | 03/062514 | A2 | 7/2003 |

OTHER PUBLICATIONS

English translation of DE 20317988 (U1).
English translation of abstract of DE102007017235 (A1).
English translation of abstract of DE102007056132 (A1).

* cited by examiner

SUPPLY DEVICE

The present invention relates to a supply device for layers of sewing material of a large area sewing product such as mattress panels for instance, comprising several layers of sewing material, preferably at least two layers, one preferably of elastic material, for instance foamed material, and one as a top layer, which layers are to be stitched together using a sewing machine with at least one sewing unit, particularly a multiple-needle sewing machine, said supply device comprising at least one roll receiver capable of receiving at least two material rolls. The invention also relates to a process for feeding a layer of sewing material from a supply device to a sewing machine with at least one sewing unit, preferably a multiple-needle sewing machine, in which preferably at least two layers of sewing material, which preferably comprise at least one layer of elastic material, for instance foamed material, and one top layer, of large area sewing products such as mattress panels for instance, are stitched together, wherein two material rolls with layers of sewing material are arranged in two holders of a roll receiver in the supply device and a first layer of sewing material is removed from one holder of the roll receiver and fed to the sewing machine.

Devices and processes of this type are known per se in prior art. Such supply devices serve to provide the sewing material to be sewn up and especially individual layers of sewing material for their processing by the sewing unit. The sewing unit may comprise a sewing material support with a presser foot arranged above the sewing material support and a needle bar in which a plurality of needles are arranged. Below the sewing material support which is designed as a perforated plate, the sewing unit includes a number of gripper hooks are attached to a rod which correspond to the number of needles. The gripper hooks and needles are moved in an oscillating manner for forming chain stitches or double chain stitches or the like in the material which is supported on the sewing material support. The sewing material is provided by the supply device, for instance by unrolling the sewing material from a material roll. A separate material roll is provided for each layer of sewing material.

A supply device of this type is disclosed for example in DE 203 17 988 U1, in which material rolls in a number corresponding to the number of layers of sewing material are horizontally arranged one behind the other. For each material roll a guiding assembly is arranged in a frame, and the respective material roll of the sewing material support can be placed in the guiding assembly. Such a guiding assembly allows the material roll being placed by its lateral area on a conveyor belt.

Vertically above each material roll a further material roll is provided using a lifting device, so that the lower material roll can be replaced by lowering the material roll arranged above the lower material roll as soon as the material of the lower material roll has been completely exhausted or needs to be changed.

Even though this supply device offers advantages concerning the setup time and the manual handling of the actually heavy material rolls, it does not yet constitute a satisfying solution considering the time which is still required for changing the layers of sewing material within different batches.

There are also known processes for sewing a material which particularly comprises at least two preferably large area layers of sewing material using an upper thread and a lower thread. Such processes are performed for instance in backstitch and preferably in double backstitch sewing machines, wherein a needle with the upper thread stitches into the sewing material and the upper thread is connected with the lower thread. To this end, a gripper hook with the lower thread engages a loop which is formed by the upper thread during the retraction of the needle, whereupon the connection between the upper thread and the lower thread is produced. At the beginning of the seam and after cutting the upper thread and the lower thread at the end of the seam, thread ends are produced in the region of both surfaces of the sewing material which are usually cut by hand. This is time-consuming and may also involve the risk of damaging the sewing material at the time of cutting the thread ends.

On part of the device, it is an object of the present invention to further develop a supply device and a process for feeding a layer of sewing material from a supply device to the effect that the handling can be facilitated and the setup time be reduced.

As a solution of this object the invention proposes a supply device in which each material roll is rotatably supported in a holder of the roll receiver and layers of sewing material can be removed from the material rolls arranged in a roll receiver and fed to the sewing unit, wherein the layers of sewing material from one roll receiver can be fed alternatively to the sewing unit.

By the fact that each material roll is rotatably supported in a holder of the roll receiver, layers of sewing material can be provided not only by the material rolls which are active in a sewing operation, but the layers of sewing material of the available material rolls can be combined in any desired manner. Accordingly, if a material roll is exhausted, the beginning of the sewing material layer of an assigned material roll can be tacked to the end of the sewing material layer of an exhausted material roll, thus quasi achieving a continuous sewing process. Setup time is merely required for the short period of switching the supply of the sewing material layer from the one material roll to the other. The sewing material layers which are tacked to each other may also vary from each other if for instance a different sewing product shall be produced by the sewing unit. It is possible in this way to achieve high flexibility and a short setup time. The supply device according to the invention is particularly beneficial with regard to an increasing number of sewing material layers, because the supply device according to the invention considerably reduces the setup time. The fact that sewing material layers can be alternatively fed from a roll receiver provides for high flexibility in the production of sewing products by the sewing unit.

Advantageously, each material roll is rotatably supported in a holder. Thus each material roll can be integrated in the manufacturing process of the sewing product in quasi any order. Time-consuming manual operations such as exchanging the material rolls or the like are not required. The holder allows a material roll supported by the holder being easily exchanged if needed. The holder allows easier and faster provision of a sewing material layer of a material roll. Preferably, the holder is a component part of the roll receiver. The roll receiver may be constituted for instance by a frame in which one or more holders can be inserted or retracted. The holder may comprise means suitable for holding the material roll in the desired position. Supporting the material roll for rotation can be implemented for instance by rotatable cylinders on the holder, on which cylinders the material roll is placed. Moreover, the material roll may be coaxially connected to a rotatable shaft which is provided on the holder, thus ensuring rotation of the material roll. The holder itself may be articulated with respect to the roll receiver, so that it can be pivoted with respect to the roll receiver. Moreover, the holder may be designed as a carriage which is movable preferably horizontally with respect to the roll receiver, thus enabling a material roll being moved out of or into the roll receiver. It can be provided for the holders of the roll receiver being arranged substantially horizontally one beside the other or vertically one above the other, thus allowing easy connection of the sewing material layers to be connected with each other.

It may be provided for the sewing material layers of neighboring material rolls to be connected with each other. Thus the new sewing material layer can be introduced in the manufacturing process substantially automatically through the previous sewing material layer.

The invention further proposes that material which is substantially identical or which is similar at least with regard to the properties essential for the sewing operation can be or is supported in the holders of a roll receiver. This allows the production of huge amounts of a sewing product, especially of a large area sewing product while simultaneously achieving a high sewing rate of the sewing unit due to the short setup time. Hence, the production speed is determined mainly by the speed of the sewing unit.

In a further development, each holder includes at least two spaced cantilever arms and a pivot for receiving a material roll extending between the cantilever arms. In this way, the material roll can be easily supported for rotation on the holder. For mounting purposes it may be provided that at least one of the cantilever arms is arranged for pivoting on the holder. This allows easy insertion of the material roll in the holder and its connection with the pivot, for instance by placing the material roll in the holder, inserting the pivot through the material roll and putting the pivot in a position to support the material roll for rotation by a pivoting movement of the cantilever arms. The cantilever arm can thus be pivoted away from the region which is used for removing the material roll from or inserting the material roll in the holder.

The holder may be trough-like with an approximately semicircular cross section and it can be adapted to the outer contour of the material roll. This design is particularly suitable in a case where the material roll is not supported on the holder via a pivot. In this design, the material roll outer contour rolls off against the holder during the removal action of the sewing material layer. A constructionally simple and reliable design of the holder can be achieved. Moving parts can be avoided. For further improving the reliability of the bearing, the holder can be preferably adapted to the outer contour of the material roll.

Furthermore, it may be provided for the holder to include a friction-reducing surface which faces the material roll. This allows on the one hand to reduce driving energy for removing a sewing material layer and on the other hand to reduce influences especially on the sewing material layer caused by removing the sewing material layer from the material roll. The friction-reducing surface may be formed for instance by a polished or chromed steel surface, thus avoiding inadmissibly high pulling forces on the sewing material layers.

A further embodiment of the holder may provide for the holder to have several rollers, namely two at least, which are supported for rotation in the holder and on which the material roll can be placed, thus achieving a simple bearing of the material roll at a low friction. This embodiment is particularly beneficial because the sewing material layer is not subject to mechanical stresses, except of the forces occurring at the time of removing a sewing material layer. This is particularly beneficial especially in the case of delicate sewing material layers.

A further development provides that several receivers, namely two at least, for respectively receiving at least two material rolls are arranged next to each other in a substantially horizontal plane preferably in such a way that the pivots of the material rolls are substantially aligned parallel to each other. By this parallel alignment the individual sewing material layers of the material rolls can be fed to the sewing unit in a simple manner, without requiring complicated alignments of the respective sewing material layers to each other. This reduces stresses on the sewing material layers during the processing. Moreover, the alignment in a substantially horizontal plane also allows the sewing material layers, particularly in large area sewing material, to be substantially uniformly stressed in the transverse direction. This is also beneficial for the processing by the sewing unit, because the individual sewing material layers can be fed at a substantially homogeneous tension. Troubles like crimping or the like in large area sewing material can be mostly avoided.

At least the upper holder of a roll receiver may include a receiving assembly by which the material roll can be conveyed to the upper holder. In this way, material rolls which are partly as heavy as 50 kg or more can be handled more easily. Manoeuvring the material rolls to the upper holder with high manual efforts is no longer required. The material roll may instead be inserted in the receiving assembly and conveyed at least partly automatically to the intended position in the holder. This also saves time.

A further development provides for the receiving assembly to include a carriage having a supporting surface that can be at least partially applied against the material roll, the carriage being movable between a retracted and an extended position relative to the holder and bendable relative to the holder in an end position that corresponds to the extended position. Thus the material roll can be securely guided during loading the holder and it can be easily inserted in the holder. In addition, this embodiment is particularly suited at least for partial automation, so that the material roll can be inserted in the holder mainly without a manual action.

In the longitudinal section, the carriage may be designed substantially L-shaped and may form a leg against which the material roll can be supported, so that in the bent end position relative to the holder a supporting structure can be formed for the material roll that is supported against the leg due to its weight. The material roll is thus securely supported against tilting with respect to the carriage. Combined with bending, a supply device can be provided which allows easy loading of a holder with a material roll.

The supporting surface can also be formed by several rollers or cylinders which are supported for rotation in the carriage. This allows easy axial positioning of the material roll in the retracted state of the carriage.

Between the carriage and the receiving assembly an energy storing device and/or a linear motor can be arranged. The energy storing device and/or the linear motor may provide for the holder with the material roll being movable to the intended position of the roll receiver substantially by pulling. Manual actions can thus be avoided to a large extent. Moreover, automation of the loading operation can thus be achieved. The linear motor may be designed as a hydraulic or pneumatic cylinder and/or the energy storing device may be designed as a tension spring capable of stretching upon movement of the carriage from the retracted to the extended position.

A further development provides for the roll receiver to have a supporting frame on which the holders are each formed as two cantilever arms arranged with a distance on the supporting frame. A material roll is rotatably supported between these cantilever arms, and a rod or cylinder which centrically passes through the material roll can be placed in the cantilever arms. This embodiment works in a case for instance in which the material roll shall be transferred to the holder using a lifting device such as fork lift. The material roll can thus be placed in the holder in which it is first supported on a base of the holder. To support the material roll for rotation, the rod or cylinder is now centrically inserted through the material roll and then placed in the cantilever arms thus achieving a rotatable bearing arrangement of the material roll. Advantageously, it is sufficient for this purpose to lift the material roll a short distance, thus achieving easy handling. The arrangement of the holder simultaneously provides for safe handling, so that dangerous situations such as slippage of the material roll or the like caused by assembly faults can be avoided.

The invention further proposes that at least one cantilever arm of each holder is designed in such a manner that it can be moved relative to the supporting frame, preferably pivoted about an axis extending parallel to the rod or cylinder and/or about a perpendicular axis, and/or in such a manner that it can be demounted. This additionally simplifies the mounting of the material roll on the holder, for instance by moving the cantilever arm for mounting purposes in such a manner that the cantilever arm releases the material roll laterally. The material roll can then be removed from the holder. Vice versa, for setup purposes, the material roll can be inserted in the holder and the rod or cylinder centrically inserted in the material roll and the material roll moved to the desired position with respect to the holder by returning the cantilever arm, thus ensuring the rotatable support of the material roll. Preferably, the cantilever arm may include a drive which simultaneously serves to lift the material roll with respect to the holder, if necessary.

A further embodiment provides that a connecting and guiding assembly for the sewing material layers to be removed from the material rolls is associated with at least two holders of a roll receiver. It is possible through the connecting and guiding assembly to hold a sewing material layer of a material roll ready for the connection with one end of a different sewing material layer that is currently not involved in the manufacturing process. This embodiment is suited among others for switching between sewing material layers for instance in a case where different sewing material layers are arranged on the material rolls of the two respective holders. But it is also possible to easily achieve the continuation of the manufacturing process with a sewing material layer that is removed from one material roll by coupling the end of this sewing material layer to the beginning of the next sewing material layer. To this end, the connecting and guiding assembly can connect the end of one sewing material layer with the beginning of the other sewing material layer.

The connecting and guiding assembly may comprise two mutually spaced clamping devices enabling at least one sewing material layer to be fixed by clamping. This embodiment enables the beginning of a sewing material layer being held ready for a quick connection. The clamping device further enables the two ends that are to be connected to be fixed in a predetermined position, thus achieving easy connection of the two ends.

Each clamping device may further include at least one cylinder that can be pivoted relative to the sewing material layer. This cylinder enables setting and adjusting the clamping effect of the clamping device to the respective sewing material layer that is to be fixed by clamping.

The invention further proposes a process for feeding a sewing material layer from a supply device to a sewing machine, wherein the second sewing material layer that is arranged next to, above or below the first sewing material layer is removed from the second material roll in the second holder of the roll receiver and fed to the sewing machine if necessary. According to the invention, two material rolls with sewing material layers are arranged in two holders of a roll receiver in the supply device, and a first sewing material layer is removed from the holder of the roll receiver and fed to the sewing machine. This enables changing the sewing material layers as needed, without involving considerable mounting work. Particularly short setup times can be achieved, because the material rolls which provide the sewing material layers according to the needs are immediately available. A change of the sewing material layers may be provided in this connection. But it can also be provided that merely the ceasing sewing material layer of the first material roll is extended by the sewing material layer of the second material roll. The invention is not limited here to the arrangement of the sewing material layers above or below. The sewing material layers may also overlap each other or be arranged adjacent to each other or both.

It is proposed for the second sewing material layer to be connected with the end of the first sewing material layer. This embodiment is particularly suited for the continuation of sewing material layers where the first material roll is exhausted and the sewing material layer is to be extended by the second sewing material layer, so that the sewing process can be continued. By this connection, the second sewing material layer is fed to the sewing unit automatically with the processing of the first sewing material layer. Repeated threading of the sewing material layers is thus unnecessary.

The invention further proposes that the first sewing material layer is separated and particularly cut into two sections substantially at right angles to its longitudinal extension, prior to its connection with the second sewing material layer. This embodiment is suited for changing the sewing operation so as to continue the sewing operation using a different sewing material layer. In this case, the first sewing material layer is cut in such a manner that the sewing product can be finished as intended. Immediately following is the second sewing material layer that is intended for a further sewing product. A simple and flexible process control can be achieved by enabling different sewing products to be manufactured in quasi any desired manner.

Advantageously, the ends to be connected are butted up against each other and are connected using an adhesive tape which overlaps both ends. The adhesive tape provides for a secure connection in such a manner that the second sewing material layer can be inserted in the sewing machine through the first sewing material layer. An inexpensive connection is achieved.

Moreover, it can be provided that the ends that are to be connected with each other are arranged in an overlapping fashion one on top of the other and are connected with each other using a connecting element penetrating through both ends, for example a plastic thread. This embodiment is particularly suited where the ends of the sewing material layers to be connected with each other have different thicknesses or the sewing material layers are not suitable for fixing an adhesive tape. A reliable connection is obtainable also for the most different sewing material layers.

It can be provided for the sewing material layers to be stored in the form of material rolls in the roll receiver above each other and/or adjacent to each other. From the production-technical view it is beneficial to arrange the sewing material layers of different material rolls to be connected with each other as closely adjacent to each other as possible, thus achieving a particularly simple construction and a simplified flow of the manufacturing process.

A further development provides that a material is stored in the holders of a roll receiver which is substantially identical or at least similar concerning the properties that are essential for the sewing process. Essential properties are for example the nature of the material such as material characteristics, loading capacity, elasticity or the like. This embodiment is particularly suited for the manufacture of large area sewing products.

Moreover, the sewing material layers to be connected with each other can be fixed in their position relative to each other prior to the connection of their ends, thus achieving a reliable connection of the sewing material layers with each other. It can be achieved in particular that the sewing material layers, for being stuck together, are butted up against each other over the entire transverse extension. Moreover, a mostly uniform overlapping portion can be obtained, which allows a reliable connection of the two sewing material layers using a plastic thread.

The supply device according to the invention can also be provided for sewing material that is designed for forming a top layer. During the manufacture of quilts or mattress panels, the sewing material is frequently changed, so that the possibility of quickly switching between different top layer materials arranged in a roll receiver is beneficial precisely in this field. Preferably, these sewing material layers are arranged in the zone just in front of the sewing unit. Here it should also be taken into account that due to the material thickness of the top layers, the rolls carrying the top layers usually have a smaller diameter than the rolls carrying elastic foamed materials.

Further advantages and features will become apparent from the following description of embodiments of the invention. Similar parts are identified with the same reference numbers. Furthermore, concerning identical features and functions, reference is made to the description of the embodiment according to FIG. 2. The drawings are schematic illustrations and merely serve to explain the following embodiment. It is shown by:

DETAILED DESCRIPTION OF THE ILLUSTRATIVE EMBODIMENT

Figure 1:
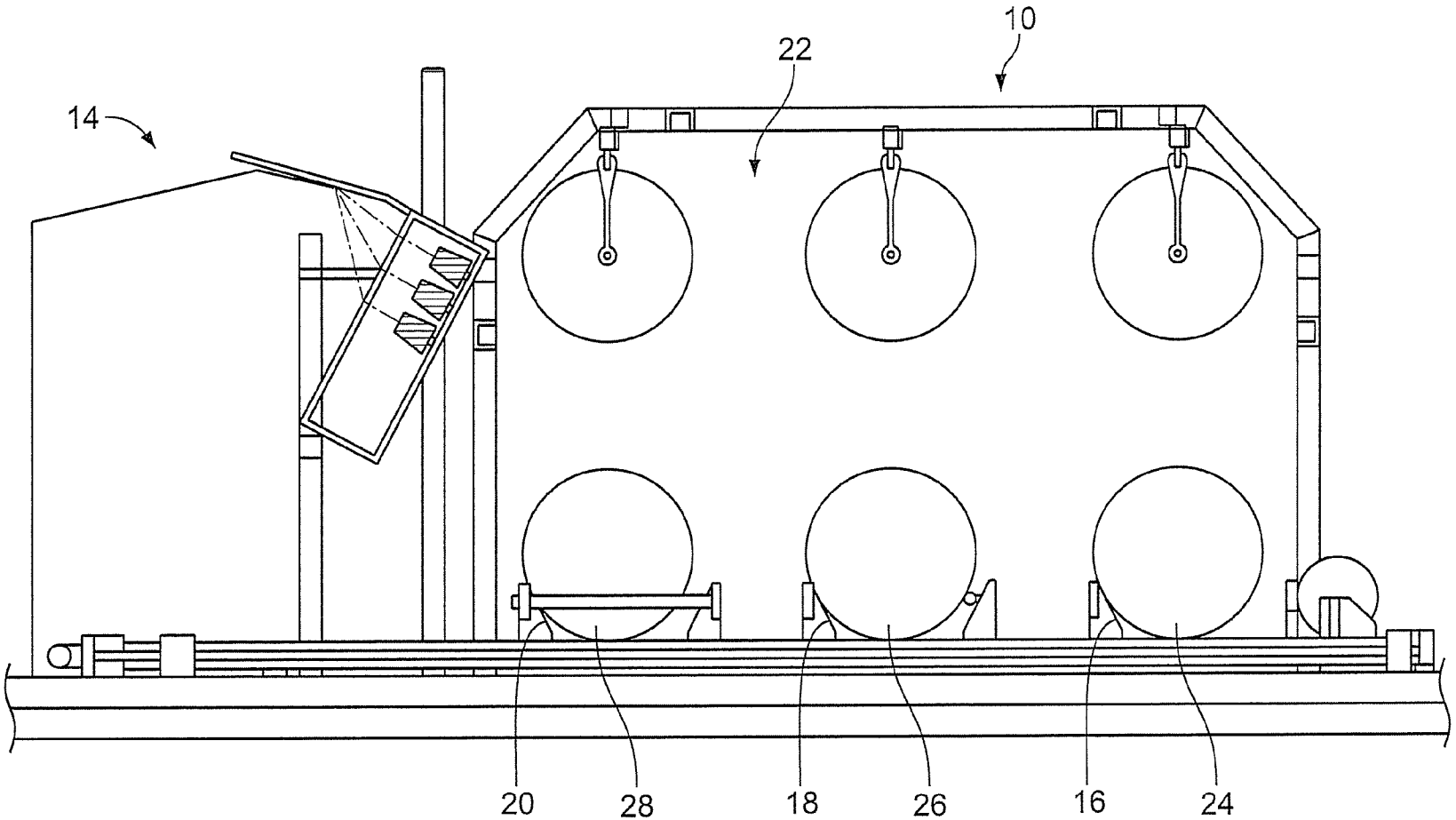
FIG. 1 a sewing unit comprising a prior art supply device, in a schematic lateral view.

FIG. 1 shows a schematic lateral view of a supply device 10 for a sewing machine 14 which comprises at least one sewing unit and with which mattress panels are produced which in the present case consist of three sewing material layers 16, 18, 20 which are each removed from a material roll 24, 26, 28. In the present case, the sewing material layer 18 consists of elastic material, namely foamed material. The sewing material layer 20 forms the top layer. The sewing material layer 16 consists of non-elastic material.

During removal the sewing material layers 16, 18, 20 are placed on top of each other and form the material to be sewn, which is fed to the sewing unit via guide rollers (not further shown). Feeding of the sewing material layers 16, 18, 20 is performed through forces acting on the sewing material. In the sewing unit, the sewing material layers 16, 18, 20 placed on top of each other are stitched together to form the sewing product. The sewing product is discharged via guide or deflection pulleys (not further shown) ensuring among others that the sewing product is tightened in the exit zone, and is supplied to secondary processing.

Above each of the material rolls 24, 26, 28 a respective replacement roll is supported, which serves to replace the material roll arranged below. To this end, the corresponding material roll 24, 26, 28 must first be removed for providing space for receiving the material roll arranged above. The latter is manually lowered to the position of the previous material roll 24, 26, 28. After a threading action the manufacturing process of the sewing product can be continued.

A drawback of this prior art is that if at least one of the three sewing material layers 16, 18, 20 is to be changed or if one of the material rolls 24, 26, 28 is exhausted, the respective material roll 24, 26, 28 must be replaced. This requires completely stopping the sewing machine 14. The changeover requires much time, because the material rolls must be transferred to different locations.

Figure 2:
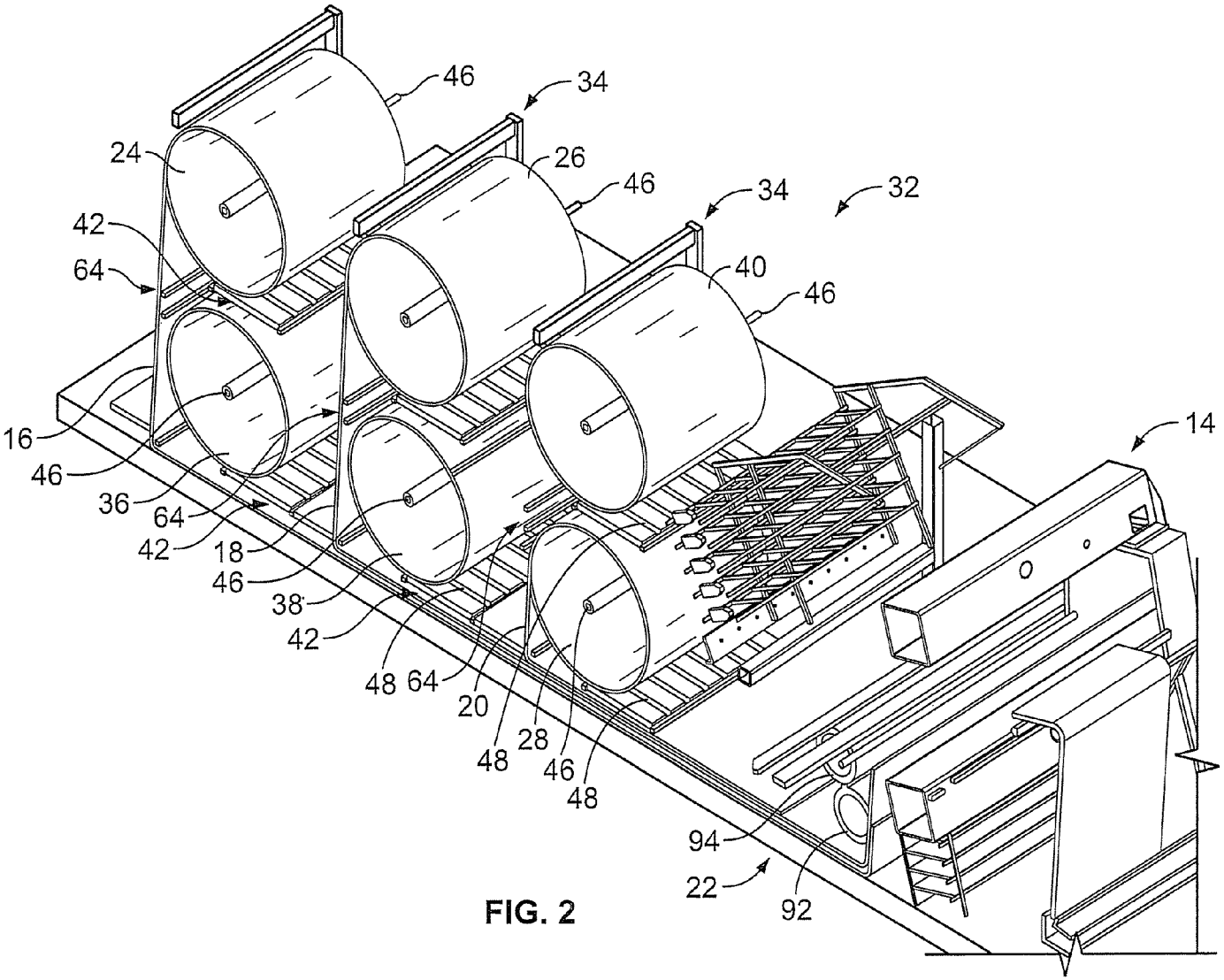
FIG. 2 a perspective view of a sewing unit comprising a supply device according to the invention.

FIG. 2 shows a supply device 32 according to the invention, which comprises three roll receivers 34. Each roll receiver 43 includes in the present case two holders 42 which are arranged in pairs vertically above each other. In the present case, the three roll receivers 34 are horizontally arranged one behind the other, so that the respective sewing material layers can be placed one on top of the other during their removal from the material rolls 24, 26, 28, 36, 38, 40 arranged in the holders 42.

Figure 3:
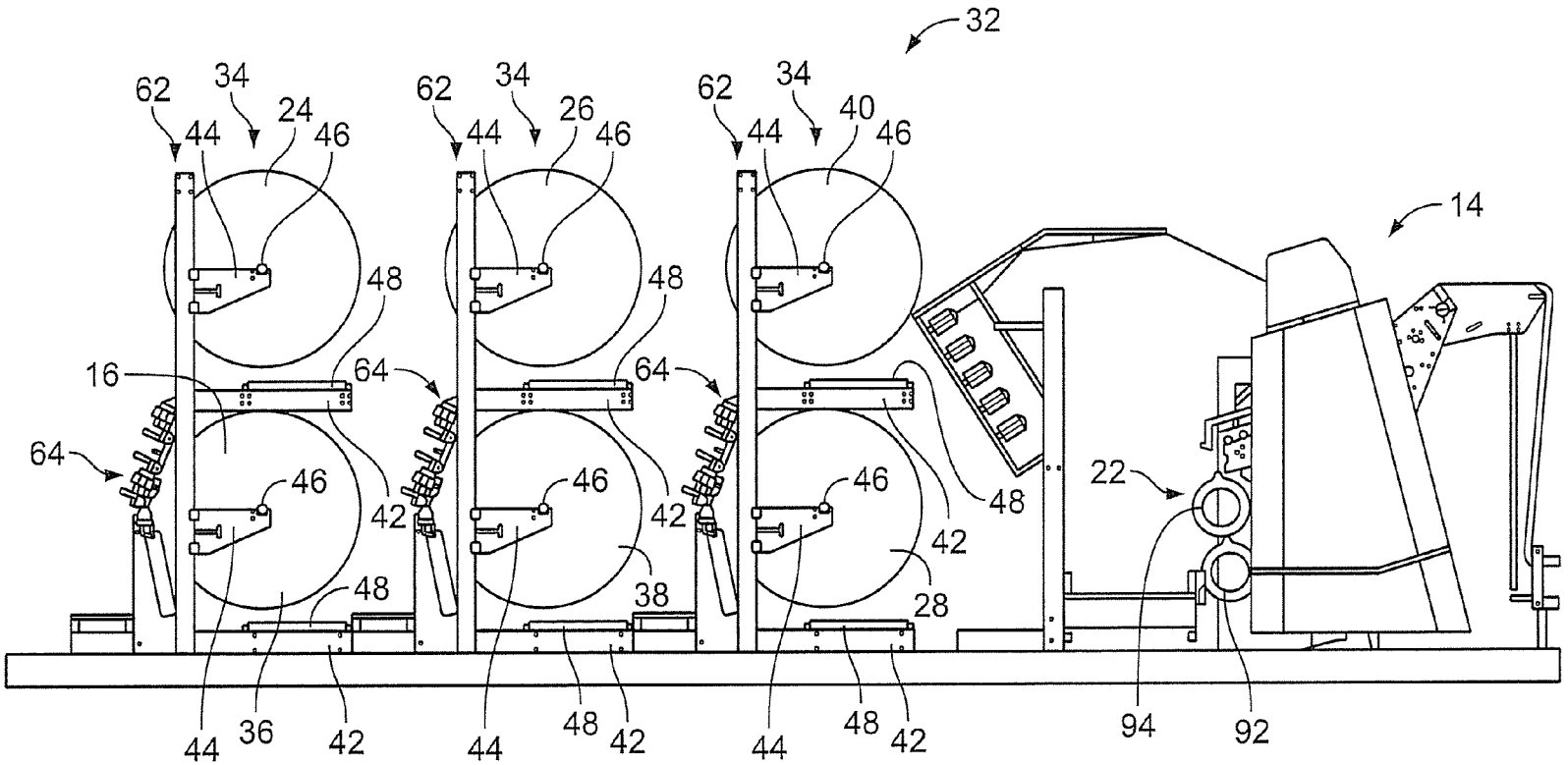
FIG. 3 a schematic lateral view of the supply device according to FIG. 2.

Each holder 42 receives a respective material roll 24, 26, 28, 36, 38, 40. Each material roll 24, 26, 28, 36, 38, 40 is supported for rotation on its respective holder 42. FIG. 3 illustrates the supply device in a schematic lateral view.

The holders 42 are a component part of the roll receiver 34. The corresponding sewing material layers can be removed from the material rolls 24, 26, 28, 36, 38, 40 arranged in the roll receiver 34 and fed to the sewing unit. In the present case, the sewing unit is of a type as previously described with regard to prior art. The holders 42 of the roll receiver 34 are arranged substantially horizontally adjacent to each other or above each other.

In the present case, the holders 42 of the roll receiver 34 hold material which is substantially identical or which is similar at least concerning the properties essential for the sewing process. Accordingly, when reaching the end of a first sewing material layer stored on the material roll 24, 26, 28, 36, 38, 40, it may be directly switched over to the vertically adjacent material roll 24, 26, 28, 36, 38, 40 by merely connecting the beginning of the second sewing material layer of the vertically adjacent material roll with the end of the first sewing material layer.

As shown by FIG. 3, each holder 42 comprises two spaced cantilever arms 44 and a pivot 46 for receiving the respective material roll 24, 26, 28, 36, 38, 40 extending between the cantilever arms 44.

Each holder 42 includes several rollers 48 which are rotatably supported in the holder 42 and on which the material roll 24, 26, 28, 36, 38, 40 can be placed. A material roll which is supported on the rollers 48 can thus be displaced in the longitudinal direction of the holder 42 without considerable efforts. This embodiment not only affords a simple exchange of the material roll 24, 26, 28, 36, 38, 40 but also the adjustment of the material roll 24, 26, 28, 36, 38, 40 in its axial position.

Figure 4:
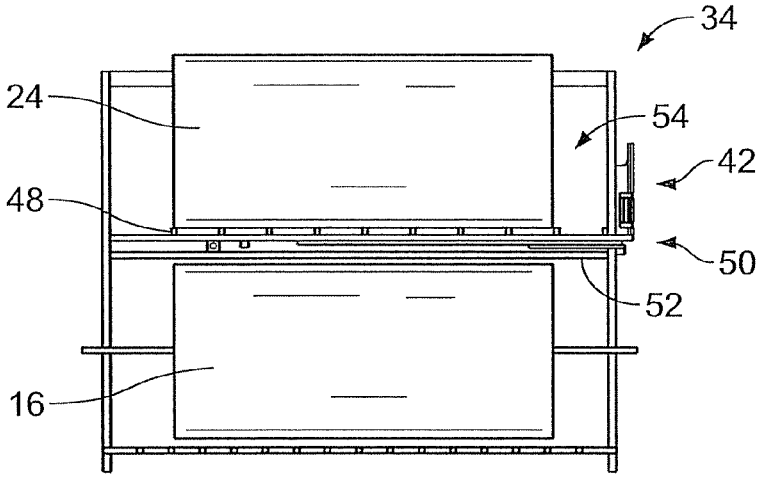
FIG. 4 a detail of a roll receiver of the supply device according to FIG. 3, comprising two material rolls arranged above each other, in a lateral view.

The present embodiment further provides for the supply device 32 to comprise three roll receivers 34, each of which is designed for receiving two material rolls 24, 26, 28, 36, 38, 40 adjacent to each other in a vertical plane, so that the pivots 46 of the material rolls 24, 26, 28, 36, 38, 40 are aligned substantially parallel to each other. FIG. 4 illustrates the roll receiver 34 for the material rolls 16 and 24.

Figure 5:
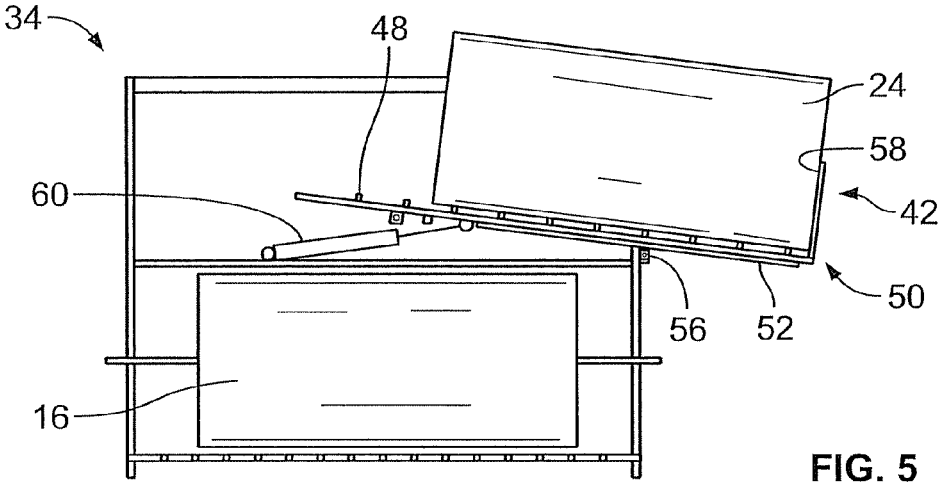
FIG. 5 the roll receiver according to FIG. 4, with the holder being partly extended laterally.
Figure 6:
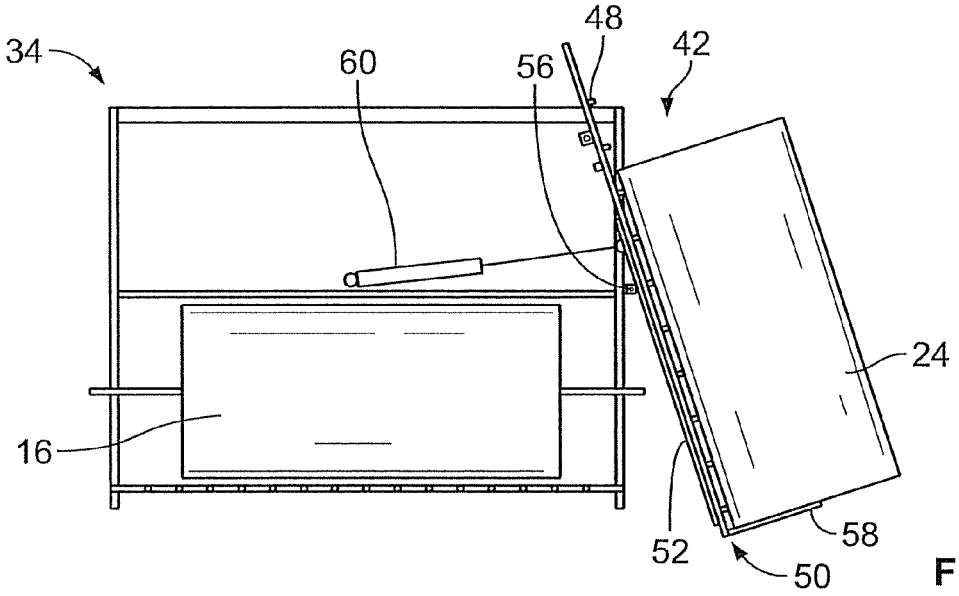
FIG. 6 the roll receiver according to the FIGS. 4 and 5, with the holder arranged in a laterally tilted position.

It is further provided that the respective upper holder 42 of the roll receiver 34 includes a receiving assembly 50, by which a material roll 24, 26, 40 can be moved to the respective upper holder 42 (FIGS. 4 to 6). For this purpose, the receiving assembly 50 includes a carriage 52 having a supporting surface 54 that can be applied against the material roll 24, 26, 40. The carriage 52 can be moved between a retracted and an extended position relative to the holder 42 and is designed for being bent relative to the holder 42 in an end position that corresponds to the extended position (FIGS. 5 and 6).

As shown by the FIGS. 5 and 6, the carriage 50 can be pivoted about an axis 56, so that it can be bent in its extended end position relative to the holder 42 in such a manner that the material roll 24, 26, 40 can be simply removed or inserted.

In the present embodiment, the carriage 52 is L-shaped in its longitudinal section. The carriage 52 forms a leg 58 as a supporting structure against which the material roll 24, 26, 40 can be supported. The material roll 24, 26, 40 can thus be replaced in an easy manner in its extended and tilted end position.

In the present embodiment, the supporting surface 54 is formed by several rollers 48 supported for rotation in the carriage 52. By these rollers 48 and with the carriage 52 in its retracted position, the material roll 24, 26, 40 can be moved to the desired axial position without considerable efforts.

Between the carriage 52 and the receiving device 50, a linear motor 60 is coupled for moving the carriage 52 between the retracted and the extended positions. A manual action for positioning the carriage 52 is thus not required. Moreover, by the arrangement of the carriage 52 and the coupling of the linear motor 60, the carriage 52 can also be tilted to the corresponding position during its movement. Accordingly, extending the carriage 52 simultaneously causes tilting about the axis 56, thus enabling the carriage 52 to be moved from its material supplying position to its roll exchanging position by only a single drive (compare FIGS. 4 to 6).

The linear motor 60 is designed as a pneumatic cylinder. But the linear motor can also be designed as a hydraulic cylinder or as an energy storing device using a tension spring.

The roll receiver 34 includes a supporting frame 62 on which the holders 42 are each formed as two spaced cantilever arms 44 arranged on the supporting frame, with a material roll 24, 26, 28, 36, 38, 40 being supported for rotation between the cantilever arms 44. A rod forming a pivot 46 can be inserted in the cantilever arms 44, and the rod or cylinder is centrically passed through the material roll 24, 26, 28, 36, 38, 40.

For exchanging the material roll 24, 26, 28, 36, 38, 40, a respective cantilever arm 44 of each holder 42 can moved relative to the supporting frame 62, namely about an axis extending parallel to the pivot 46. This makes it possible for the respective cantilever arm to preferably pivot away downwards, thus releasing the carriage 52 for moving the respective material roll 24, 26, 40 in the axial direction while the material roll 25, 26, 40 is supported on the carriage.

It can be seen in the FIGS. 2 and 3 that two holders 42 respectively of a roll receiver 34 are associated with a connecting and guiding assembly 64 for sewing material layers to be removed from the material rolls 24, 26, 28, 36, 38, 40. This connecting and guiding assembly allows fixing of a beginning or end of a sewing material layer of a material roll currently not involved in the manufacturing process. To this end, the connecting and guiding assembly 64 includes two mutually spaced clamping devices by which the respective sewing material layer can be fixed in a clamping fashion. Though not illustrated, each clamping device includes at least one cylinder that can pivoted relative to the sewing material layer.

The process flow for feeding a sewing material layer will be described in the following:

Sewing material layers 14, 16, 18 are fed from the supply device 32 to a sewing machine 14 with a sewing unit for stitching the sewing material layers together. To this end, the supply device 32 includes six material rolls 24, 26, 28, 36, 38, 40 from which respective sewing material layers 16, 18, 20 can be removed. The material rolls 24, 26, 28, 36, 38, 40 are arranged in pairs vertically above each other in roll receivers 34.

As shown by FIG. 2, it is provided that the material rolls 24, 26, 28 supply sewing material layers 16, 18, 20 which are placed one on top of the other and are fed to the sewing unit via deflection and guide pulleys not further shown. In the present embodiment, the sewing material layers 16, 18, 20 are stitched together to form mattress panels. Two material rolls 24, 26, 28, 36, 38, 40 with sewing material layers 16, 18, 20 are respectively arranged in two holders 42 of a roll receiver 34. A first sewing material layer 16, 18, 20 is removed from a holder 42 of the roll receiver 34 and fed to the sewing machine 14.

If necessary, the sewing material layer 16, 18, 20 above or below the first sewing material layer 16, 18, 20 can be removed from the respective second material roll 24, 26, 28, 36, 38, 40 in the second holder 42 of the corresponding roll receiver 34 and fed to the sewing machine 14. For this purpose, the second sewing material layer 16, 18, 20 is connected with the end of the first sewing material layer 16, 18, 20. For this purpose, the first sewing material layer 16, 18, 20 can be cut on its end substantially at right angles to its longitudinal extension for forming a straight edge, prior to its connection with the second sewing material layer 16, 18, 20.

The ends intended for connection are butted up against each other and are connected with each other using an adhesive tape which overlaps both ends. Accordingly, by a continuation of the manufacturing process, the second sewing material layer 16, 18, 20 is fed to the sewing unit automatically through the first sewing material layer, for continuing the sewing process. Mounting operations for exchanging material rolls 24, 26, 28, 36, 38, 40 can thus be reduced to a minimum or are performed independently of the manufacturing process. The sewing material layers 16, 18, 20 are stored in the form of material rolls 24, 26, 28, 36, 38, 40 above each other in the roll receiver 34. Material rolls 24, 26, 28, 36, 38, 40 arranged in the holders 42 of a roll receiver 34 store identical materials or materials which are similar at least concerning the properties essential for the sewing process.

To achieve a good connection of the ends of the sewing material layers 16, 18, 20 to be connected, these sewing material layers 16, 18, 20 are fixed in their position relative to each other, prior to connecting their ends. For this purpose, the material rolls 24, 26, 28, 36, 38, 40 may be displaced in their axial position to each other.

The FIGS. 2 and 3 additionally show two material rolls 92, 94, which are also arranged in a roll receiver, these material rolls 92, 94 storing so-called top layer material which is placed and sewn as the uppermost layer at the manufacture of quilts or mattress panels for example. The manufacture of quilts and mattress panels requires frequent changes between the top layer materials for sewing pre-planned batches of a different design. The above-described advantages of the supply device 10 of the invention thus also apply to a supply device 10 including a roll receiver for this top layer material according to the material rolls 92 and 94. It can be seen in the FIGS. 2 and 3 that these material rolls 92 and 94 are supported in the roll receiver 22 in direct vicinity of the sewing machine 14, so that the top layer material is also provided in the direct vicinity of the sewing unit. It should be noted that all the features of the roll receiver 22 as illustrated in the supply device 10 according to FIGS. 2 and 3 and described above may be provided also with regard to the material rolls 92 and 94 in their dedicated roll receiver 22 directly in front of the sewing machine 14. The above-described advantages are thus also obtained in this region.

Figure 12:
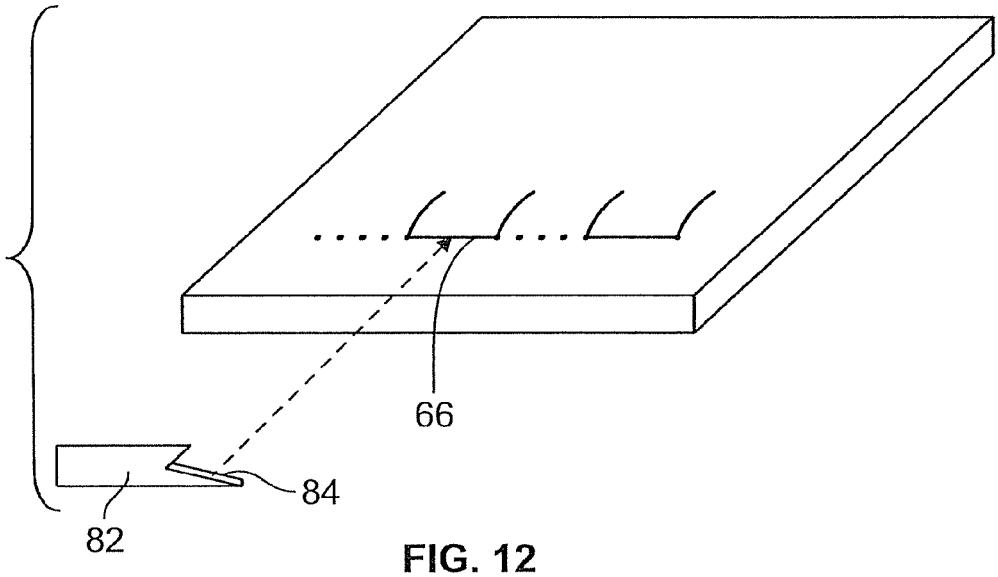
FIG. 12 a section of sewing material with the upper thread tensioned, in a perspective view.
Figure 13:
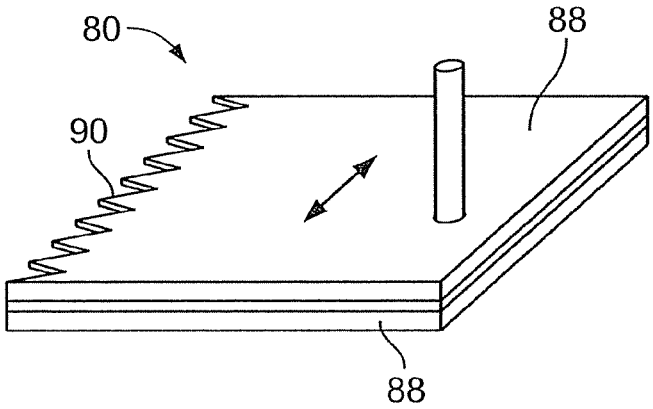
FIG. 13 a cutting device for cutting thread ends, in a perspective view.
Figure 14:
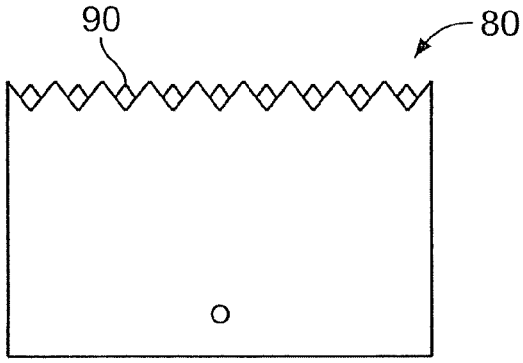
FIG. 14 the cutting device according to FIG. 13 in a plan view.

A sewing process will now be described with reference to the following figures wherein it is shown by:

FIGS. 7 to 11 schematic process steps of a sewing process and for cutting a thread of a lock-stitch sewing machine;

FIG. 12 a section of sewing material with the upper thread tensioned, in a perspective view;

FIG. 13 a cutting device for cutting thread ends, in a perspective view; and FIG. 14 the cutting device according to FIG. 13 in a plan view.

Figure 7:
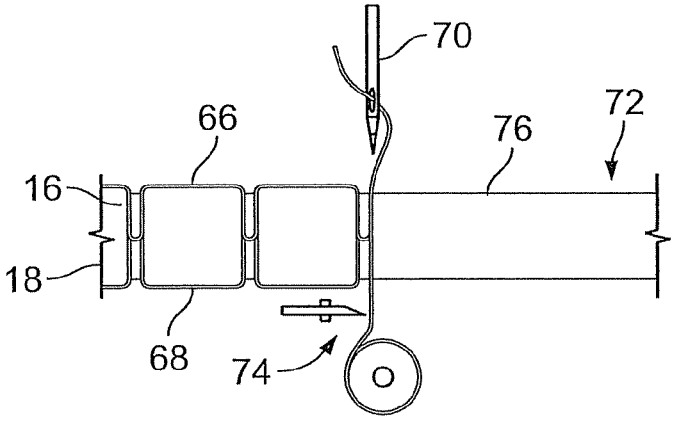
FIGS. 7 to 11 schematic process steps of a sewing process and for cutting a thread of a lock-stitch sewing machine.

The FIGS. 7 to 11 illustrate a process for sewing a sewing material 72 which is formed of two large area sewing material layers 16, 18 which are connected to each other using an upper thread and a lower thread 66, 68. During this process, a needle 70 of a sewing unit (not further illustrated) stitches together with the upper thread 70 into the sewing material 72. The upper thread 66 is connected with the lower thread 68, whereupon the needle 70 is removed from the sewing material 72 (FIG. 7).

Figure 8:
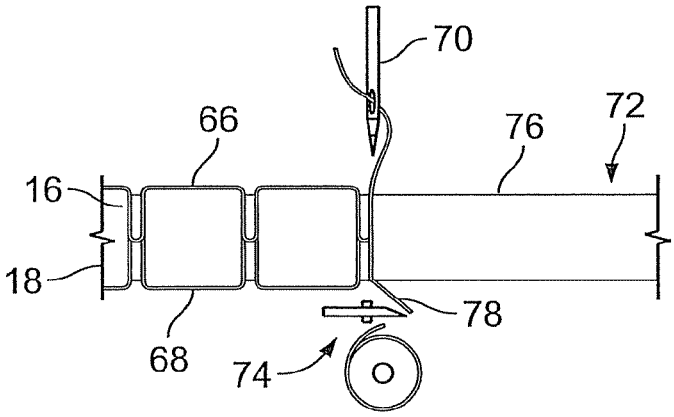
Figure 9:
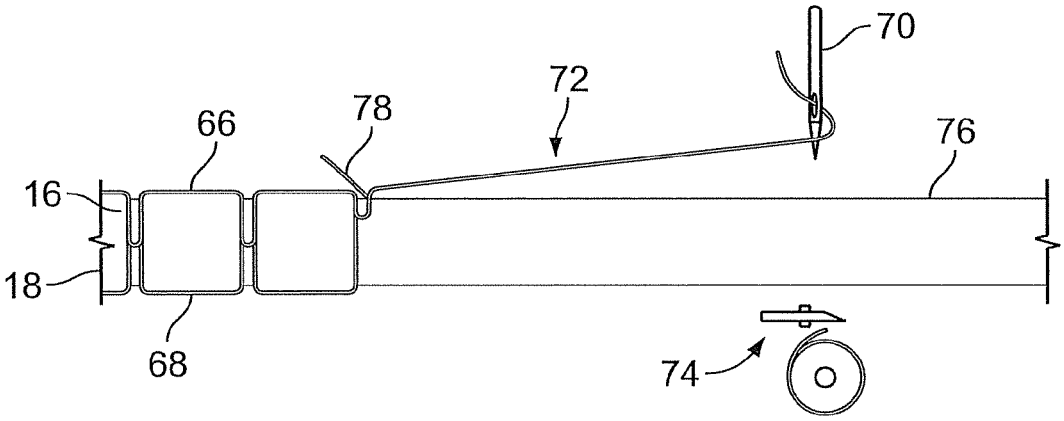

For separating the lower thread 68 from the sewing material 72, a cutting device 74 cutting the lower thread 68 is arranged below the sewing material 72, i.e. in the region of the surface of the sewing material 72 facing away from the needle (FIG. 8). After the lower thread 68 is cut and a free end 78 formed, the sewing material 72 is moved in the transport direction, thus tensioning the upper thread 66 in such a manner that the lower thread 68 which is connected with the upper thread 66 is pulled with its free end until a position above an surface 76 facing the needle 70, so that the end 78 of the lower thread 68 can be removed in the region of this surface 76. The lower thread 68 is cut before tensioning the upper thread 66 at the end of a sewing section. As an alternative for moving the sewing material 72 the upper thread 66 may also be tensioned using an independent tensioning lever not further illustrated (FIG. 9).

The free end 78 of the lower thread 68 now protruding over the surface 76 is cut substantially flush with the surface 76. For this purpose a cutting device 80 is provided which will be described in the following (FIGS. 13, 14). The lower threads 68 are for instance cut in such a manner that their free ends 78 protruding over the surface 76 have a length of 10 mm at maximum. The part of the lower thread 68 protruding over the surface 76 is cut using a cutting device 80 that operates in a two-dimensional fashion. It is provided that substantially each needle 70 has an associated cutting device.

Figure 10:
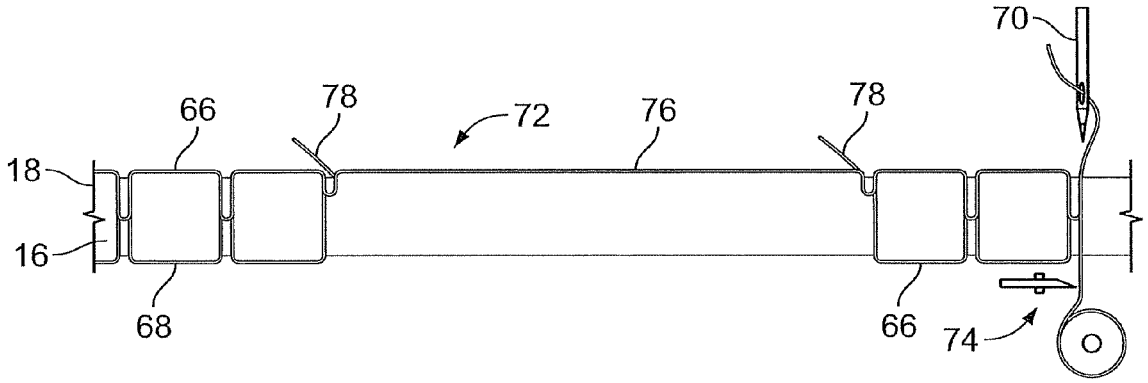

A further embodiment provides that also the upper thread 66 is cut, if the same rests on the surface 76, due to the transport of the sewing material 72 between the end of a seam and the beginning of a following seam (FIG. 10).

Figure 11:
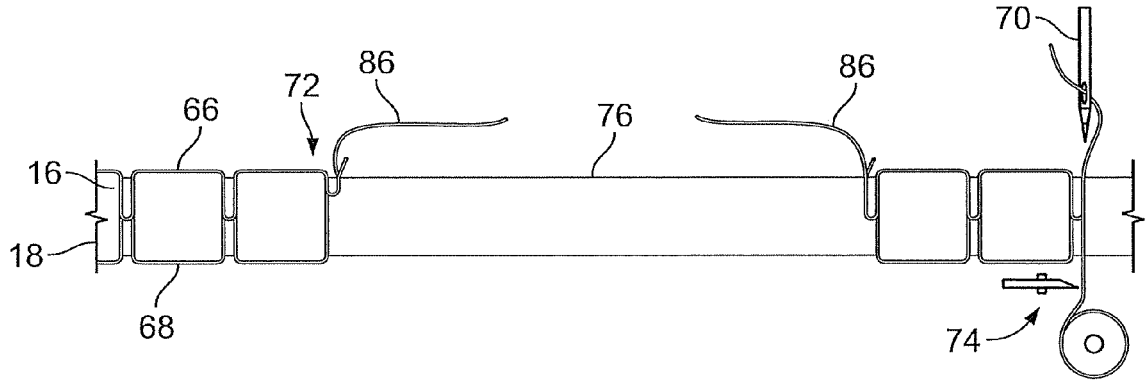

The upper threads 66 running on the surface 76 and not sewn up with the sewing material 72 are substantially centrally cut using a knife 82 (FIGS. 11 and 12).

For this purpose, the knife 82 which is movable transversely to the transport direction includes a cutting blade 84. The cutting blade 84 is arranged inclined with respect to the surface 76 and approaches the surface under an acute angle. Its tip can thus nip the upper thread 66, which is cut by a sliding over the cutting blade 84. This produces thread ends 86 of the upper thread 66. The thread ends 86 can then be cut by the cutting device 80 together with the thread ends 78 of the lower thread 68 in one working step (FIGS. 13 and 14). If necessary, air is blown against the thread ends of the lower threads and/or the upper threads or the thread ends of the lower threads and/or the upper threads are aspirated, thus providing for a reliable cutting operation.

It is provided that the lower thread 68 is pulled onto the surface 76 facing the needle 70 by means of the upper thread 66 also at the beginning of a seam.

The cutting device 80 includes two two-dimensional cutting plates 88 which are arranged substantially parallel to each other and which can be displaced to each other by sliding. On one side, the two cutting plates 88 include sawtooth-like appendices in the form of a sawtooth profile 90 causing a cutting effect on their adjacent edges when the cutting plates 88 are displaced against each other along the extension of the sawtooth profile 90. The cutting device 80 is used for cutting the thread ends 78, 86 along the surface 76 of the sewing material 72. The length of the thread ends 76, 86 can be adjusted by a corresponding selection of the cutting plates 88.

The embodiments illustrated in the figures merely serve to explain the invention and are not intended to limit the invention.

LIST OF REFERENCE NUMBERS

10 supply device
14 sewing machine
16 sewing material layer
18 sewing material layer
20 sewing material layer
22 roll receiver
24 material roll
26 material roll
28 material roll
32 supply device
34 roll receiver
36 material roll
38 material roll
40 material roll
42 holder
44 cantilever arm
46 pivot
48 roller
50 receiving assembly
52 carriage
54 supporting surface
56 axis
58 leg
62 supporting frame
64 connecting and guiding assembly
66 upper thread

68 lower thread
70 needle
72 sewing material
74 cutting device
76 surface
78 end of the lower thread
80 cutting device
82 knife
84 cutting blade
86 end of the upper thread
88 cutting plates
90 sawtooth profile
92 material roll
94 material roll

The invention claimed is:

1. A supply device for a sewing machine, particularly a multiple-needle sewing machine, with at least one sewing unit, for sewing material layers of a large-scale sewing product such as mattress panels comprising several sewing material layers, particularly at least three, preferably having one sewing material layer of elastic material, for example foamed material, and one sewing material layer intended as a top layer, which layers are to be stitched together using the sewing machine, said supply device comprising:

at least two material rolls;

at least one roll receiver capable of receiving the material rolls;

a holder being arranged at the roll receiver, wherein each material roll is rotatably supported in a holder of the roll receiver;

means for removing the material layers from the material rolls arranged in the roll receiver, and for feeding the material layers to the sewing unit; and wherein the sewing material layers can be alternatively fed to the sewing unit from the roll receiver and wherein the sewing material layers are immediately available from the material rolls in the roll receiver and can be alternatively supplied to the sewing unit without requiring an exchange of material rolls.

2. The supply device according to claim 1, wherein each material roll is rotatably supported in the holder.

3. The supply device according to claim 1, wherein the holders of the roll receiver are arranged substantially horizontally adjacent to each other or vertically above each other.

4. The supply device according to claim 1, wherein material is stored or storable in the holders of the roll receiver which is identical or which is at least similar with regard to the properties essential for the sewing process.

5. The supply device according to claim 1, wherein each holder includes at least two spaced cantilever arms and a pivot for receiving the material roll extending between the cantilever aims.

6. The supply device according to claim 1, wherein the holder is designed in a trough-like fashion in such a way that it can be adapted to the outer contour of the material roll.

7. The supply device according to claim 6, wherein the holder includes a friction-reducing surface facing the material roll.

8. The supply device according to claim 6, wherein the holder includes several, at least two, rollers which are rotatably supported in the holder and on which the material roll can be placed.

9. The supply device according to claim 1, wherein several, at least two, roll receivers for respectively receiving at least two material rolls are arranged adjacently to each other in a substantially horizontal plane in such a manner that the pivots of the material rolls are aligned substantially parallel to each other.

10. The supply device according to claim 1, wherein at least an upper holder of the roll receiver includes a receiving assembly by which the material roll can be conveyed to the upper holder.

11. A supply device for a sewing machine, particularly a multiple-needle sewing machine, with at least one sewing unit, for sewing material layers of a large-scale sewing product such as mattress panels for example, comprising several sewing material layers, particularly at least three, preferably having one sewing material layer of elastic material, for example foamed material, and one sewing material layer intended as a top layer, which layers are to be stitched together using the sewing machine, said supply device comprising:

at least two material rolls;

at least one roll receiver capable of receiving the material rolls;

a holder being arranged at the roll receiver, wherein each material roll is rotatably supported in a holder of the roll receiver;

means for removing the material layers from the material rolls arranged in the roll receiver, and for feeding the material layers to the sewing unit;

wherein the sewing material layers can be alternatively fed to the sewing unit from the roll receiver and at least an upper holder of the roll receiver includes a receiving assembly by which the material roll can be conveyed to the upper holder; and wherein the receiving assembly includes a carriage having a supporting surface which can be applied at least partly against the material roll and being movable relative to the holder between a retracted and an extended position and being bendable relative to the holder in an end position that corresponds to the extended position.

12. The supply device according to claim 11, wherein the carriage is substantially L-shaped in the longitudinal section, and wherein a leg forms a supporting structure supporting the material roll.

13. The supply device according to claim 11, wherein the supporting surface consists of several rollers or cylinders rotatably supported in the carriage.

14. The supply device according to claim 11, wherein an energy storing device and/or a linear motor are arranged between the carriage and the receiving assembly.

15. The supply device according to claim 14, wherein the linear motor is designed as a hydraulic or pneumatic cylinder and/or that the energy storing device is designed as a tension spring that can be stretched upon a movement of the carriage from the retracted to the extended position.

16. The supply device according to claim 11, wherein the roll receiver includes a supporting frame on which the respective holders are formed as two cantilever arms arranged with a distance in the supporting frame and between which the material roll can be supported for rotation, wherein a rod or cylinder can be placed in the cantilever arms, said rod or cylinder centrically passing through the material roll.

17. The supply device according to claim 16, wherein at least one cantilever arm of each holder is designed in such a manner that it can be displaced relative to the supporting frame, preferably pivoted about an axis extending parallel to the rod or cylinder and/or about a perpendicular axis, and/or in such a manner that it can be demounted.

18. The supply device according to claim 11, wherein at least two holders of the roll receiver are associated with a respective connecting and guiding assembly for the sewing material layers to be removed from the material rolls is associated with.

19. The supply device according to claim 18, wherein the connecting and guiding assembly includes two mutually spaced clamping devices by which at least one sewing material layer can be fixed by clamping.

20. The supply device according to claim 19, wherein each clamping device includes at least one cylinder which can be pivoted relative to the sewing material layer.

21. A process for feeding a sewing material layer to a sewing machine, particularly a multiple-needle sewing machine, the process comprising:

providing a supply device having a roll receiver, the roll receiver having at least two holders, namely, a first holder and a second holder;

arranging at least two material rolls, e.g. a first material roll and a second material roll, wherein one material roll is arranged at each of the holders;

providing at least two sewing material layers, preferably at least a first sewing material layer of elastic material, and a second top layer of large-scale sewing products such as mattress panels;

providing each of the material rolls with one of the sewing material layers, particularly, the first material roll is provided with the first sewing material layer, and the second material roll is provided with the second sewing material layer, wherein the second sewing material layer arranged adjacent to, above or below the first sewing material layer;

removing the sewing material layers from the material rolls of the holder of the roll receiver;

feeding the at least two sewing material layers from the supply device to a sewing unit of the sewing machine;

stitching together the sewing material layers by the sewing unit;

wherein the second sewing material layer can be removed if necessary from the second material roll in the second holder of the roll receiver and fed to the sewing machine in case of need and without requiring an exchange of material rolls the second sewing material layer which is placed next to, above or beneath the first sewing material layer is unrolled from a second material roll in a second support of the roll receiver and alternatively supplied to the sewing machine; and wherein the first and second sewing material layers are provided from immediately available material rolls of the roll receiver.

22. The process according to claim 21, wherein the second sewing material layer is connected with the end of the first sewing material layer.

23. The process according to claim 22, wherein the first sewing material layer, prior to its connection with the second sewing material layer, is separated, particularly cut, into two sections substantially at right angles to its longitudinal extension.

24. The process according to claim 22, wherein the ends to be connected with each other are butted up against each other and are connected with each other using at least one adhesive tape which overlaps both ends.

25. The process according to claim 22, wherein the ends to be connected with each other are arranged in an overlapping fashion one on top of the other and are connected with each other using at least one connecting element penetrating through both ends.

26. The process according to claim 21, wherein the sewing material layers are stored in the form of material rolls above each other and/or adjacent to each other in the roll receiver.

27. The process according to claim 21, wherein, in the holders of a roll receiver, material is stored which is substantially identical or at least similar with regard to the properties essential for the sewing process.

28. The process according to claim 22, wherein the sewing material layers to be connected with each other are fixed in their position relative to each other prior to connecting their ends.

* * * * *